US010046454B2

(12) United States Patent
Klecker

(10) Patent No.: US 10,046,454 B2
(45) Date of Patent: Aug. 14, 2018

(54) TOOL HEAD ADAPTED FOR REMOVABLE ATTACHMENT TO A HANDLE

(71) Applicant: Glenn Klecker, Silverton, OR (US)

(72) Inventor: Glenn Klecker, Silverton, OR (US)

(73) Assignee: Klecker Knives, LLC, Silverton, OR (US)

( * ) Notice: Subject to any disclaimer, the term of this patent is extended or adjusted under 35 U.S.C. 154(b) by 346 days.

(21) Appl. No.: 14/606,438

(22) Filed: Jan. 27, 2015

(65) Prior Publication Data

US 2015/0209953 A1 Jul. 30, 2015

Related U.S. Application Data

(60) Provisional application No. 61/933,130, filed on Jan. 29, 2014.

(51) Int. Cl.

| | |
|---|---|
| ***B25G 3/20*** | (2006.01) |
| ***B26B 23/00*** | (2006.01) |
| *B25G 3/24* | (2006.01) |
| *B25G 3/12* | (2006.01) |
| *B26B 7/00* | (2006.01) |

(52) U.S. Cl.

CPC ..... *B25G 3/20* (2013.01); *B26B 23/00* (2013.01); *B25G 3/12* (2013.01); *B25G 3/24* (2013.01); *B26B 7/00* (2013.01)

(58) Field of Classification Search

CPC ..... B25B 13/16; B25G 3/20; B26B 23/00
USPC ..... 81/488; 7/144, 163
See application file for complete search history.

(56) References Cited

U.S. PATENT DOCUMENTS

| | | | | |
|---|---|---|---|---|
| 316,528 | A | 4/1885 | Davis | |
| 626,285 | A * | 6/1899 | Metzger | B25B 7/00 7/130 |
| 861,127 | A * | 7/1907 | Frank | F16J 1/12 277/336 |
| 1,049,249 | A | 12/1912 | Martini | |
| 1,336,185 | A | 4/1920 | Bantjes | |

(Continued)

OTHER PUBLICATIONS

"wrench." https://www.mso.anu.edu.au/~ralph/OPTED/ The Online Plain Text English Dictionary, 2016. Web. Dec. 27, 2016.*

(Continued)

*Primary Examiner* — Monica Carter
*Assistant Examiner* — Katina Henson
(74) *Attorney, Agent, or Firm* — Schwabe, Williamson & Wyatt, P.C.

(57) ABSTRACT

A tool head for easy attachment and detachment to a handle is provided for configurations such as axes, picks, shovels, sledges, hatches, and hoes. The tool head includes two clamps, one clamp being threadingly engaged on a shaft that freely rotates within the tool head. To attach the tool head to a handle, the user rotates the shaft which moves the clamps together and compresses the handle there between first clamp moves towards a second clamp. To detach, the shaft is counter rotated thereby decompressing the handle. When detached from a handle, the clamps turn and nest in two cutouts within the tool head allowing for compact storage or packing. Integrally formed features that include scraper, blade, wrenches, gut hook, cord cutter, carabineer, and the like provide the user in the field needed tools when fashioning a handle from a sapling or stick.

10 Claims, 9 Drawing Sheets

(56) References Cited

U.S. PATENT DOCUMENTS

| | | | | |
|---|---|---|---|---|
| 2,114,149 | A * | 4/1938 | Irving | A46B 17/00 15/145 |
| 2,435,556 | A | 2/1948 | Curatole | |
| 3,355,226 | A | 11/1967 | Portz | |
| 4,089,356 | A | 5/1978 | O'Connor | |
| 4,334,565 | A | 6/1982 | Stokes | |
| 4,347,883 | A | 9/1982 | Fariss, Jr. | |
| 4,558,726 | A | 12/1985 | Clay | |
| 4,773,286 | A | 9/1988 | Krauth | |
| 5,152,065 | A | 10/1992 | Harding | |
| 5,211,085 | A | 5/1993 | Liou | |
| 5,768,956 | A | 6/1998 | Coonrad | |
| 2013/0197489 | A1* | 8/2013 | Rister | A61B 17/00 606/1 |

OTHER PUBLICATIONS

"nested." Merriam-Webster.com. Merriam-Webster, 2016. Web. Dec. 27, 2016.*

"lever." Thesaurus.com. Thesaurus, 2016. Web. Dec. 27, 2016.*

Tim Stetzer; Innovative Essential; Knives Illustrated Magazine; Dec. 2014; pp. 18-27; vol. 28, No. 7; Publisher Engaged Media by Beckett; Yorba Linda, CA 92887 USA.

* cited by examiner

TOOL HEAD ADAPTED FOR REMOVABLE ATTACHMENT TO A HANDLE

CROSS-REFERENCE TO RELATED APPLICATIONS

This application claims priority under 35 U.S.C. § 119(e) (1) to U.S. Ser. No. 61933130 filed Jan. 29, 2014, which is hereby incorporated by reference in its entirety.

STATEMENT REGARDING FEDERALLY SPONSORED RESEARCH OR DEVELOPMENT

Not Applicable

BACKGROUND OF THE INVENTION

Technical Field

This invention relates generally to hand-held tools of the type having a tool head attached to the end of a handle. More specifically, this invention relates to tool heads configured to easily attach and detach from roughly formed handles and precision formed handles.

Prior Art Discussion

Tool heads, having tool features such as axe blades, hammer surfaces, pick points, are commonly fitted with handles made of wood. Relatively light, durable, and readily available, wood historically has been the preferred handle medium for hand-held tools. The conventional fixation of a tool head to a wood handle involved shaping a handle end to fit within the body of the tool head, followed by wedges being driven into the end of the handle to make up for any minor imperfections and to compressively wedge the handle within the tool head. Handles installed with wedges tend to be permanent for the life of the handle, are not easily removed, and the handle must be exactly formed to fit within the tool head.

Not all wooden handles install within a tool body. Previous inventors have improved the handle configuration by setting the tool head within a notch in the handle end. As taught in U.S. Pat. No. 1,336,185 to Bantjes, the tool head inserts within a slot that fittingly holds the handle on either side, the handle being further secured to the head with threaded through pins or rivets. The handle's cross section closest to the tool head is substantially increased, thereby making the Bantjes handle less susceptible to failure when leveraged rotational forces are applied. However, the Bantjes tool head is not easily removable, nor does it present as being usable with a roughly formed handle. As similarly disclosed in U.S. Pat. No. 5,768,956 to Coonrad, the receiving handle is constructed having a slot for the tool head. But again, the wood handle machining must be precise to tightly fit the sides of the handle head, and once the tool head is installed in the handle, it remains attached for the handle's useful life.

Being unable to remove a tool head from a handle was addressed by Alfred Harding U.S. Pat. No. 5,152,065 "Tool head having an easily replaceable handle attached thereto" using the conventional "handle in head" configuration, with the improvement being a removable tool head side that removably engages the tool head with a plurality of threaded fasteners. The threaded fasteners requiring a second set of tools in order to install or remove a handle. The Harding tool head further requires a handle that is exactly formed to fit within the tool head and the removable tool head side.

Another example of a removable tool head is provided in U.S. Pat. No. 4,347,883 titled "Easily removable handle means for axes and the like" to James D. Fariss. The Fariss tool head attachment also followed the conventional configuration of the wooden handle end being inserted within a void within the tool body. The improvement involving a slot in one end of the handle, through which a lag type screw forcibly spread the handle sides against the tool body interior when tightened. The Fariss tool head replaced wedges with a lag screw, thereby allowing the user to easily unscrew the lag to remove the handle. However, the Fariss handle required exact shaping to make fit within the tool body, and additional machining to form the receiving slot for the screw lag. Another deficiency in the Fariss handle is the requirement of a second tool required by the user to tighten or loosen the screw lag.

Therefore, an unfulfilled need exists for an improved tool head that easily attaches and detaches from a precision machined or a roughly formed handle, without the need of any additional tools.

SUMMARY AND OBJECTS OF INVENTION

In view of the foregoing disadvantages and inherent deficiencies in the known types of removable tool heads using currently practiced attachment apparatus, the tool head according to one or more embodiments described herein departs from the conventional concepts and designs of the prior art, and in doing so provides a clamping apparatus that removablely attaches the tool head to an unlimited variety of handle options. The tool head further having integrally formed tool features that are usable with and without attachment to a handle that provide among other things, handle crafting functions when forming a rough handle in the field. For compact carry when not attached to a handle, the clamps rotate to a flat nested position within the tool head. When nested, the tool head is functionally usable as a multi-tool tool, enabling the user to chop, scrape, cut, wrench, and generally use the tool features that are integrally formed in the tool head when not on a handle.

The improved tool head disclosed has two clamp attachment, one clamp on either side of the handle. A first clamp is threadingly engaged on a shaft that is located within an internal cavity in the tool head. When the shaft is rotated, the first clamp moves closer to a second clamp, and further away when the shaft is counter-rotated. The user rotates a knob that is fixated to the shaft to compress the handle between the first and second clamps, thereby attaching the handle to the tool head, and counter-rotates the shaft to decompress the clamps for detachment.

The integral tool features allow the user to fashion a handle in the field from various mediums such as saplings, bundles of branches, or even a section of PVC pipe. To cut a sapling and form a handle for example, the axe blade is used to chip away and cut through a suitably sized sapling, then cuts the handle to the desired length. Once cut to length, sharpened scraper blade is used to form the handle and handle surfaces. The handle is finished by splitting or cutting a notch in one end of the handle using either the axe blade or scraper. The tool head is received within the notch such that the handle material projects between the first and second clamps on either sides of the tool head. To attach, the shaft is rotated, thereby compressing the handle end between the clamps. To detach the tool head from the handle, the shaft is counter-rotated.

When not on a handle, the tool head has a flat profile with the clamps nesting within the body for compact packing, storage, or transport. With the clamps nested, the tool head is easily held in the user's hand similar to a fixed knife blade, providing supplementary function as a hand-tool, making it ideal for survival or emergency preparedness kits.

While the following disclosure and preferred embodiments are particularly directed to a tool head that removably engages a handle, it will be understood by those familiar in the hand tool arts that the present invention also relates to most any implement that needs attachment to a handle. Some of the objects of the present invention are to provide a tool head that is for: Removable use with roughly formed handles; Engaging and disengaging a handle without additional tools; Compact flat storage when not attached to a handle; Manually forming a handle in the field; Striking such as with hammers, axes, hatches, mallets, or picks; Leveraging, pushing, or lifting such as with pitchforks, shovels, or rakes; and Attachment and use on the end of a pole, branch, PVC pipe, or cable.

Upon review of the following descriptions taken in combination with accompanying figures, other objects, advantages, and features of the present invention will become apparent to those skilled in the art.

DETAILED DESCRIPTION

Figure 1:
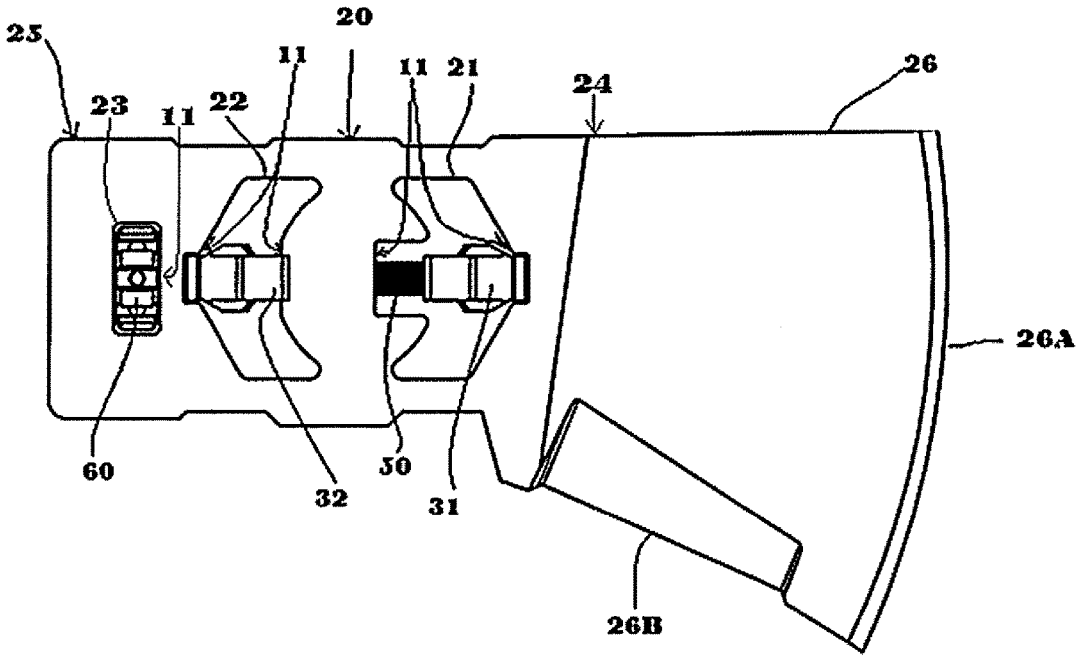
FIG. 1 is a right side view of the tool head adapted for removable attachment to a handle, the embodiment shown configured as an axe without a handle with the clamps deployed.
Figure 2:
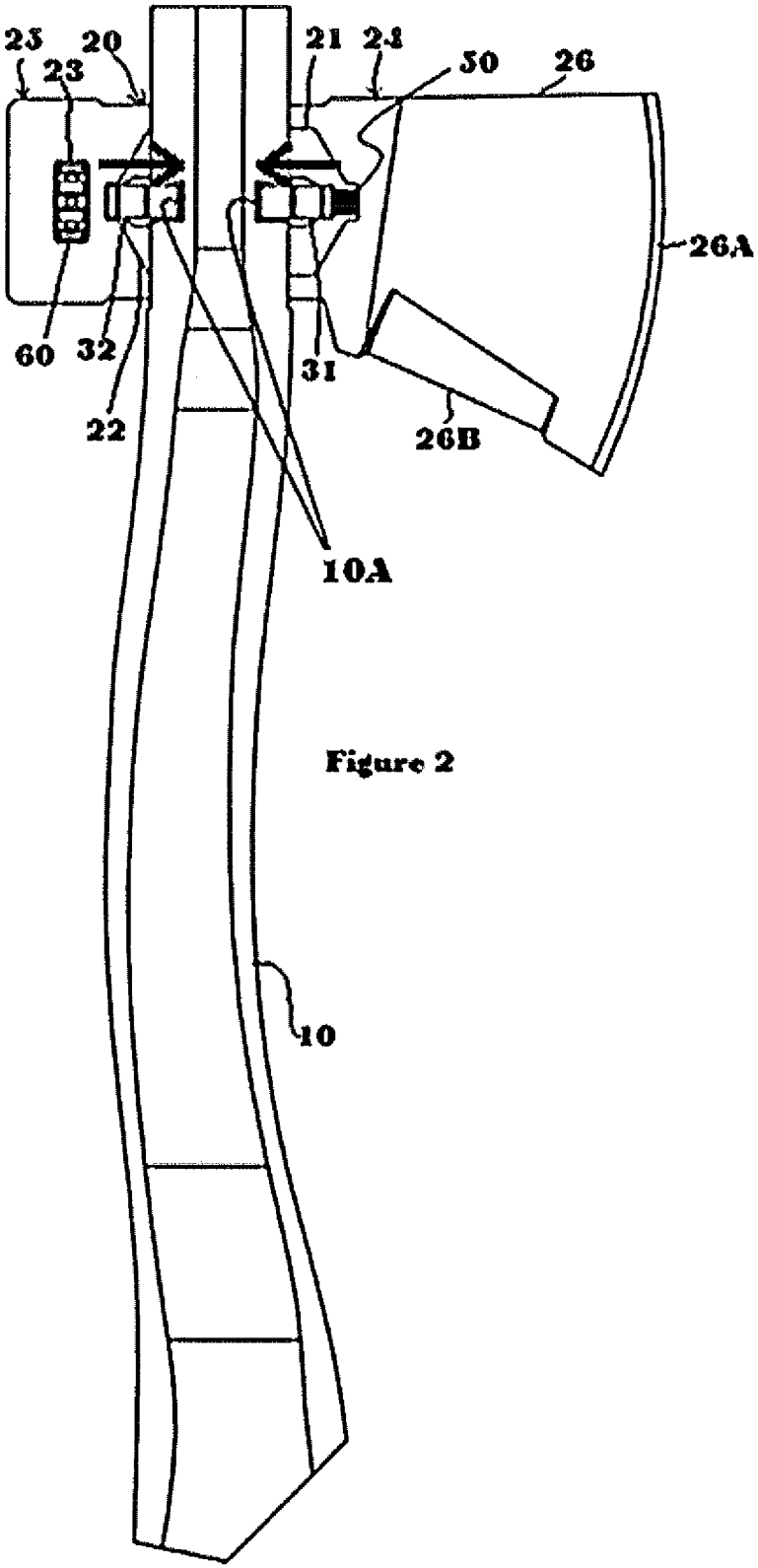
FIG. 2 is a right side view of the tool head in FIG. 1, shown attached to a precision formed handle.

Referring now to the preferred embodiment shown in FIG. 1 without a handle and FIG. 2 with a handle, the tool head having a first end 24, a second end 25, with a mid-portion 20 there between. At least the first end 24 being configured as a tool end 26 having an axe blade 26A with scraper 26B. The mid-portion 20 includes a first cutout 21, a second cutout 22, a third cutout 23, and a cavity 11 that extends through the mid-portion 20, being in open communication with the first cutout 21, second cutout 22, and third cutout 23. As further depicted by cutaway view in FIG. 3., the cavity 11 is bounded between the first end 25 and second end 24, and provides a cylindrical void in which a shaft 50 freely rotates. Within the first cutout 21 a first clamp 31 is threadingly engaged on the shaft 50 portion that has matching threads. Within the second cutout 22 a second clamp 32 is slidingly engaged on the shaft 50 portion that has no threads. A knob 60 fixates on the shaft 50 within the third cutout 23, the knob 60 providing the user a leveraged way to turn the shaft 50, thereby moving the first clamp 31 towards the second clamp 32.

The tool head shown in FIG. 1 is depicted in FIG. 2 as attached to a precision formed handle 10 with the mid-portion 21 of the tool head fitting within a notch or split in the end of the handle 10. As discussed above, when the shaft 50 is rotated, the first clamp 31 moves closer to the second clamp 32 thereby applying a compressive force depicted by arrows in FIG. 2 against the handle 10 at indent 10A locations. When the shaft 50 is counter rotated, the first clamp 31 is moved away from the second clamp 32 decompressing the handle 10 and moving the first clamp 31 and second clamp 32 out of the indents 10A, thereby detaching the tool head from the handle 10. The indents 10A as depicted were precision formed before attachment to the tool head.

Figure 3:
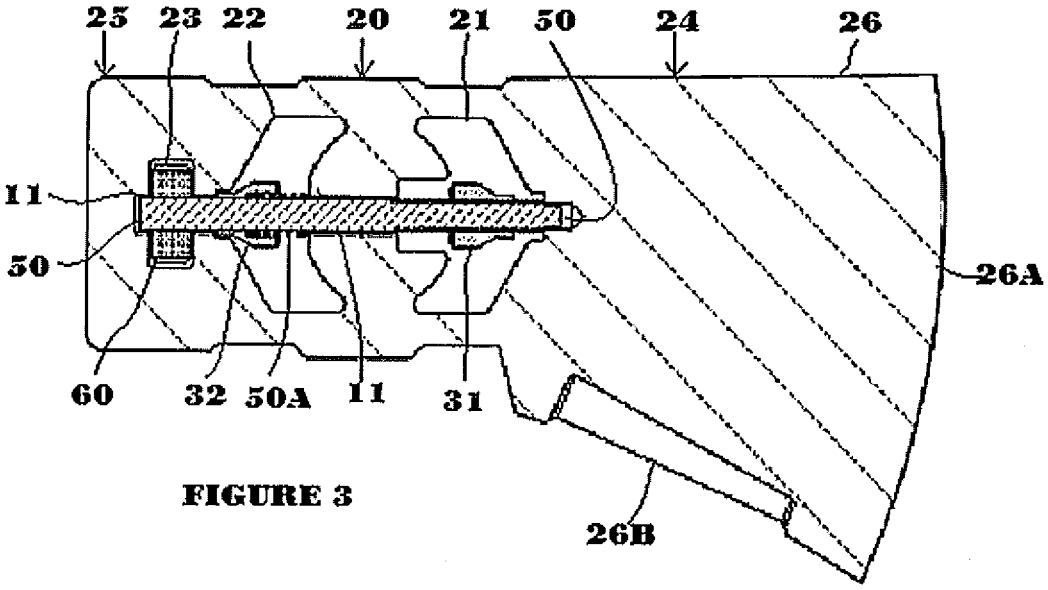
FIG. 3 is a right side cutaway view of the tool head in FIG. 1 without a handle and the clamps deployed.

The tool head embodiment shown in FIGS. 1 and 2 is depicted in FIG. 3 by a right side cutaway view. As shown, the cavity 11 extends through the mid-portion 20, the first cut out 21, second cut out 22, and third cutout 23, terminating between the first end 24 and second end 25. Constructing the cavity 11 may be performed in many suitable ways, and as shown, involves drilling or boring through the mid-portion 20 from the second end 25, stopping short of the first end 24. In other embodiments as shown in FIG. 5, the cavity 11 extends through the second end 25 and a handle 61 fixates on the shaft 50 to provide rotational torque.

Figure 4:
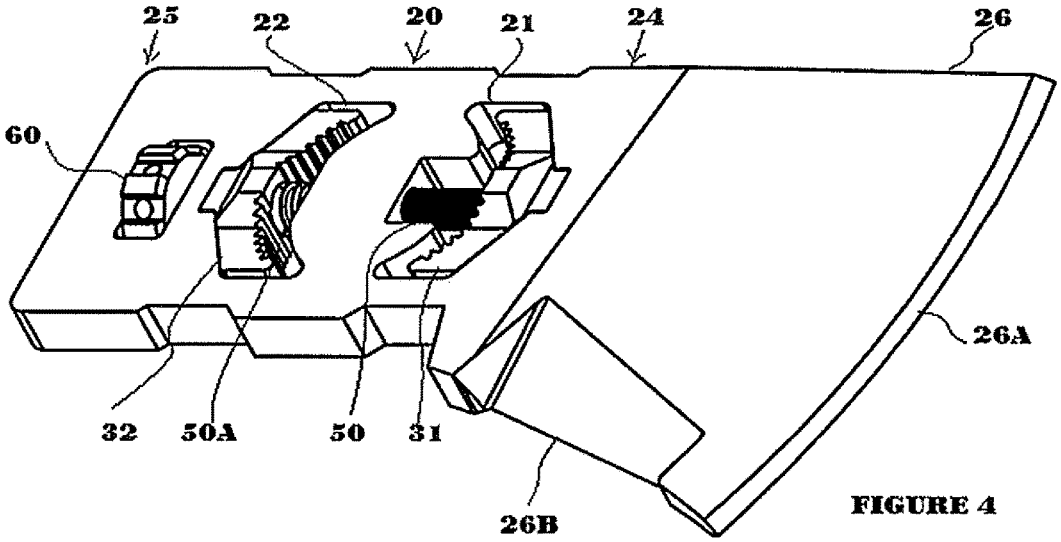
FIG. 4 is a lower right perspective view of the tool head in FIG. 1 without a handle and the clamps nested.

As shown in FIGS. 1-3 and by right front lower perspective in FIG. 4, the clamps 31, 32 are cooperatively shaped and sized to fit within the cutouts 21, 22 respectively. The tool head embodiment shown in FIG. 4 further includes a spring 50A around the shaft 50 within the second cutout 22 that biases the second clamp 32 towards the second end 25. When not deployed for handle 10 attachment, the first clamp 31 and second clamp 32 rotate about the axis of the shaft 50, until fitting within the first cutout 21 and second cutout 22 respectively, thereby nesting the clamps 31, 32 in a flat profile allowing for compact storage or minimal space packing. Nesting of the first clamp 31 involves turning the first clamp 31 to fit within the first cutout 21, then counter rotating the shaft 50 until the first clamp 31 is pressed into the first cutout 21. Unlike the first jaw clamp 31, the second jaw clamp 32 is not internally threaded, and thus remains stationary while the shaft 50 is rotated. When nesting the second clamp 32 the user pushes the second clamp 32 against the bias of the spring 50A to turn the second clamp 32 in a position that fits within the second cut out 22. The spring 50A maintains a force on the second clamp 32 that keeps it pressed within the second cut out 22.

Figure 5:
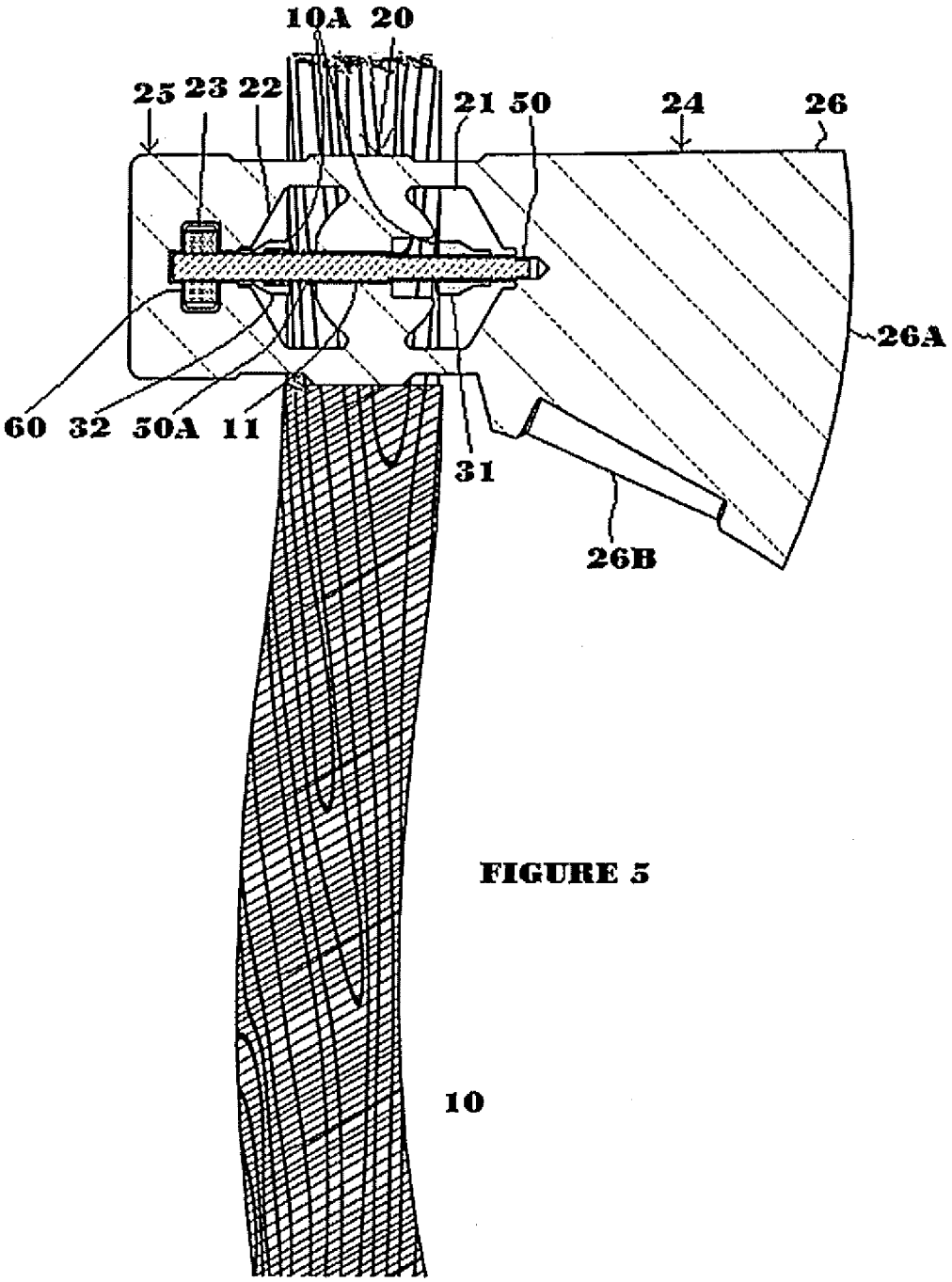
FIG. 5 is a cutaway right side view of the tool head in FIG. 1 attached to a roughly formed handle.

As depicted in FIG. 5 as a cutaway view of the tool head attached to a field fashioned handle 10, the handle 10 may be crafted from a soft sapling or pliable stick, and the indents 10A are preferable formed at the correct location in the handle 10 by compressing the handle 10 between the first clamp 31 and second clamp 32, as similarly shown in FIG. 2. By rotating the knob 60 the first clamp 31 and second clamp 32 bite into the handle 10 forming the indents 10A. To deepen the indents 10A while improving attachment between the tool head and the handle 10, the user can alternate tapping the second end 25 of the tool head against a solid surface with rotating the knob 60 to compressively seat in the first clamp 31 and second clamp 32 into the rough handle 10 material.

Figure 6:
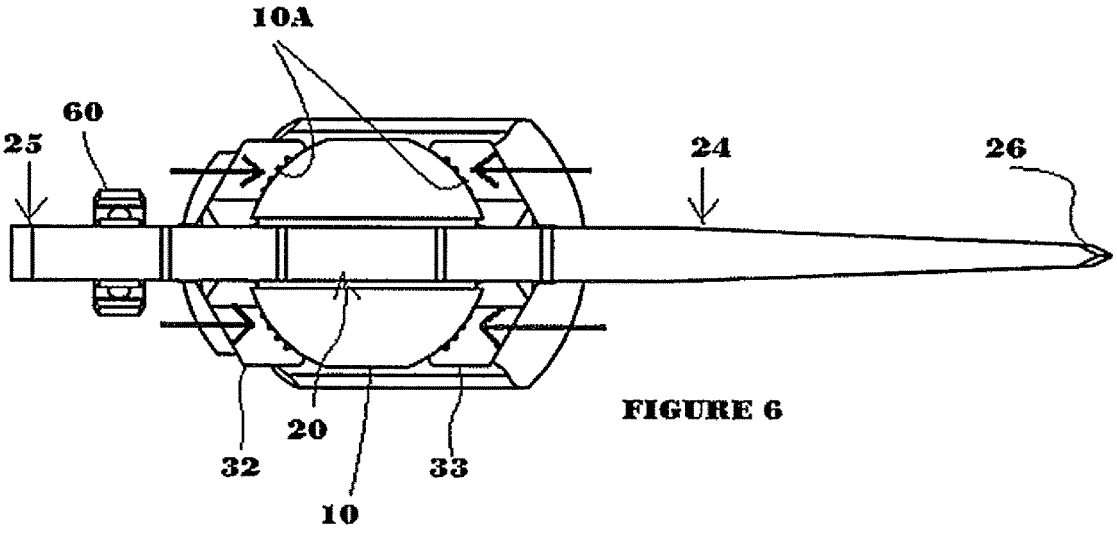
FIG. 6 is top down view of the tool head in FIG. 2 attached to a handle with the clamps deployed.

As first shown in FIG. 2 from a right side view, and in FIG. 6 from a top down view having the tool head located within a notch or split in the handle 10 end with the mid-portion 20 resting within. When the first clamp 31 is moved closer to the second clamp 32, compressive forces depicted by arrows push the first clamp 31 and second clamp 32 into the handle 10 at indent 10A locations. The compressive forces applied by the first clamp 31 and second clamp 32 to the handle 10 attach the handle 10 for use with the tool head.

Figure 7:
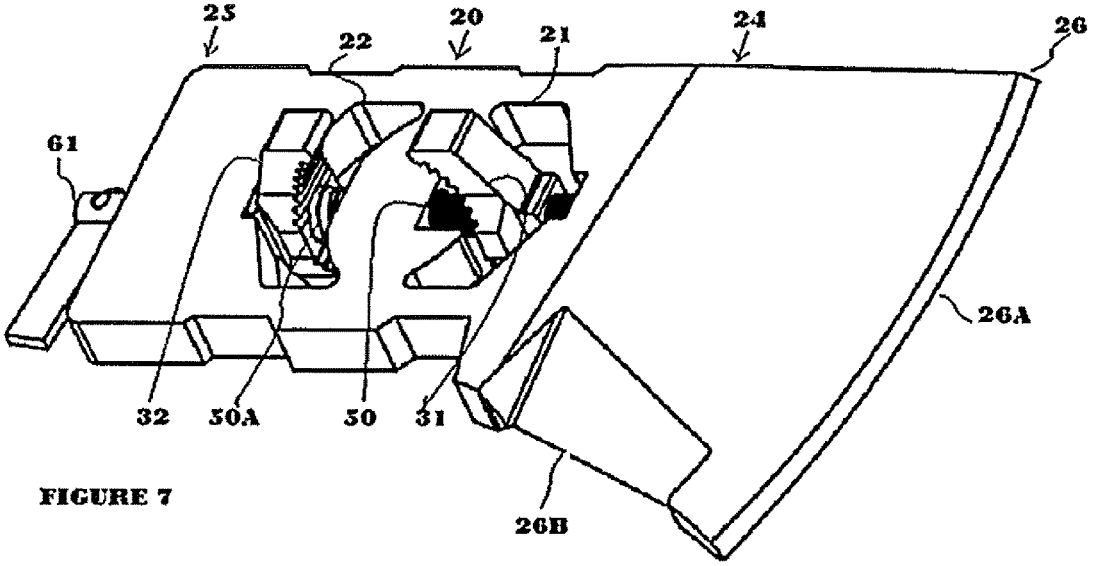
FIG. 7 is a lower right perspective view of the tool head configured with a lever rather than a knob for rotating the shaft shown without a handle, and the clamps deployed.

The tool head shown in FIGS. 1-6 depict a knob 60 which increases leverage and user grip when rotating the shaft 50. As shown in FIG. 7, when additional leverage or rotational force is desired to rotate the shaft 50, the knob 60 can be replaced by a lever 61. The tool head being differently configured wherein the cavity 11 and shaft 50 extend through the second end 25, and the shaft 50 fixates to the lever 61 such that when the user turns the lever 61, the shaft 50 rotates easier than when rotated by the knob 60.

Figure 8:
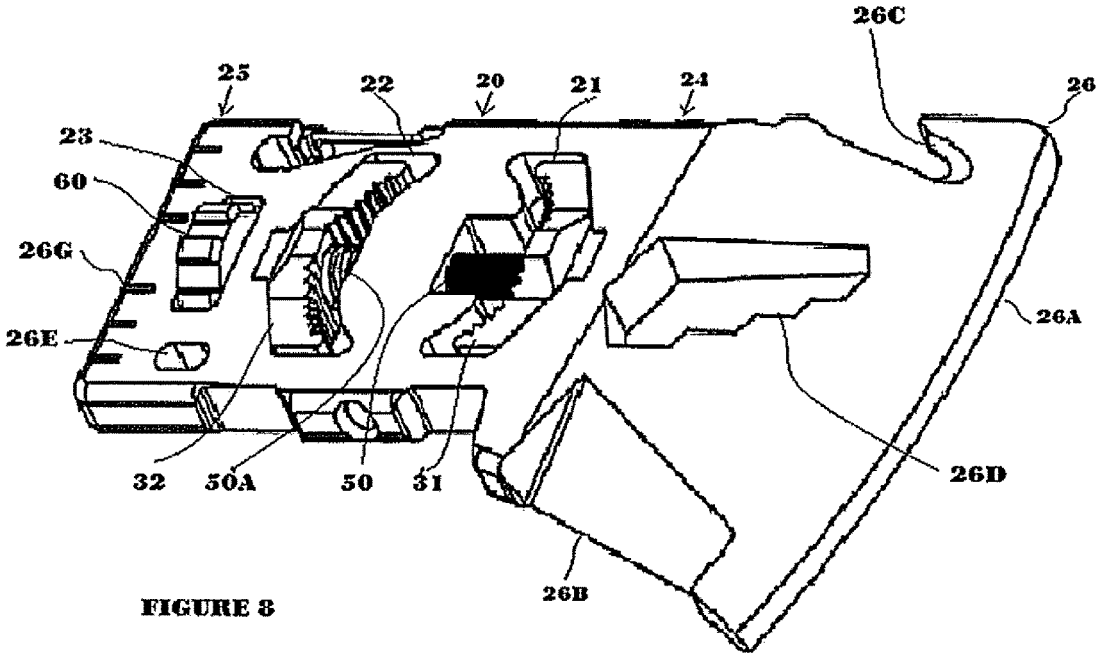
FIG. 8 is a lower right perspective view of the tool head shown in FIG. 1 configured with a plurality of integrally formed tool features shown without a handle, and the clamps nested.

As depicted in FIG. 8 where minimalism is balanced against maximum utility, at least one additional tool feature is integrally formed from the tool body 10 shown in earlier figures. The axe blade 26A and scraper blade 26B are complimented with a cord cutter 26C, wrenches 26D, lanyard hole 26E, carabineer 26F, or a ruler 26G. These integrally formed tool elements prove useful both when the tool head is attached to a handle, and when detached. In the survival circumstance or field environment when the user has only the tool head without a handle, the integrally formed tool elements provides necessary function when manually crafting a roughly formed handle from materials such as a limb, bundles of sticks, or tree sapling. The addition of tool features increases the usefulness of the tool head as a multi-tool when not on a handle, allowing the user to use the wrenches 26D on a bicycle for example.

Figure 9:
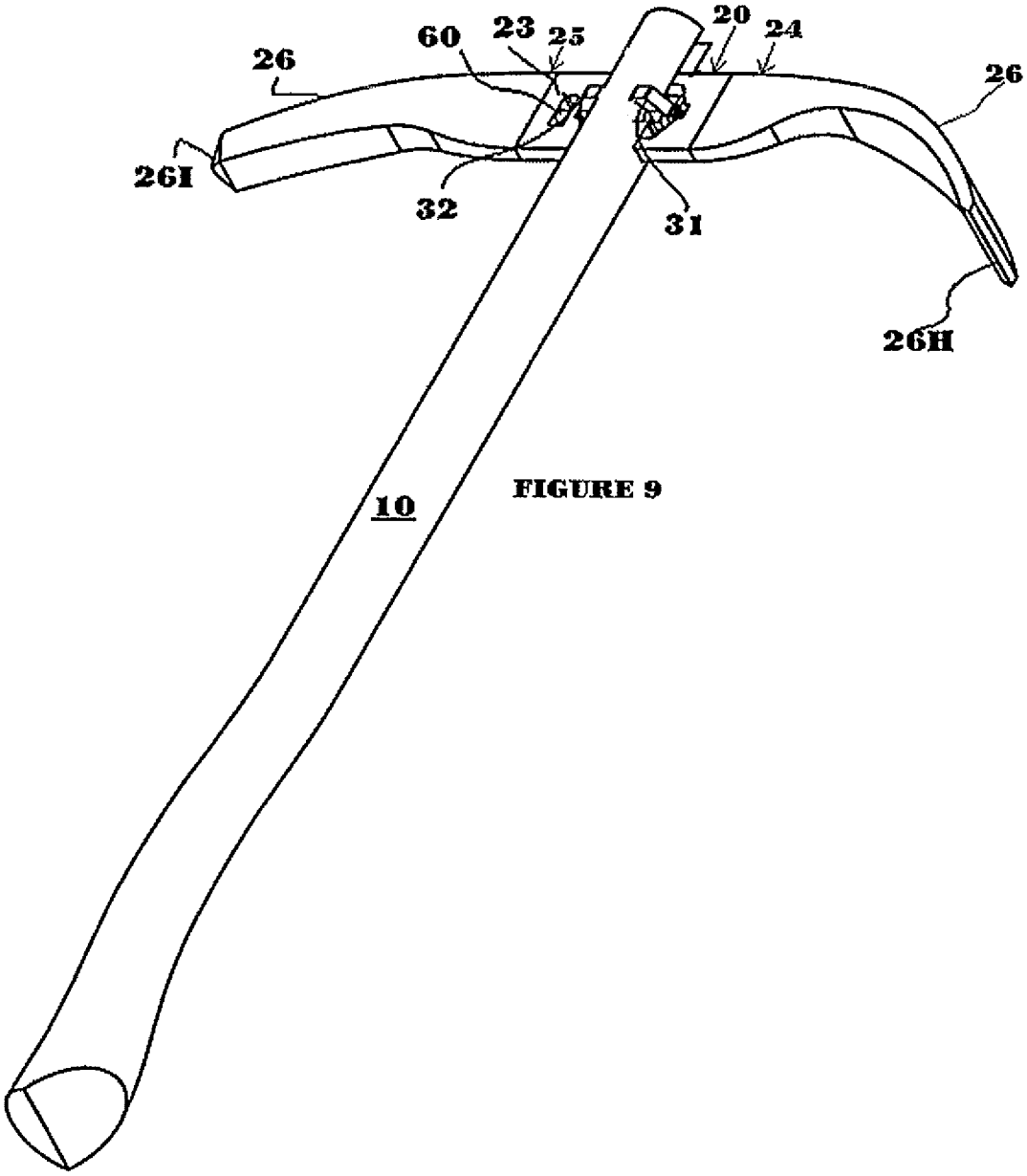
FIG. 9 is a lower right perspective view of the tool head configured as a pick and hoe attached to a handle.

The embodiments disclosed in FIGS. 1-8 demonstrate the tool end 26 configured as an axe blade 26A that is easy to attach and detach from a handle 10 just by rotating the shaft 50. The tool end 26 configuration shown in previous FIGs as an axe 26A in no way should be interpreted as limiting the tool head to only axe type application, as one skilled in the art will immediately recognize that the disclosed apparatus for attaching the tool to the handle 10 would work for a hammer, pick, shovel, or a hoe. The tool configurations are as limitless as the suitable handle materials. For example as depicted in FIG. 9 showing the tool head configured with the first end 24 and second end 23 both being tool ends 26. On the first end 24 the tool end 26 configuration is a hoe 26H, and on the second end 25 a pick 26I.

While the invention has been disclosed in certain embodiments and detailed descriptions, it will be clear to one skilled in the art that modifications or variations of such details can be made without deviating from the essence and substance of this invention, and such adaptions or variations are considered to be within the scope of the claims provided herein.

I claim:

1. A tool head adapted for removable attachment to a slotted handle end, the tool head comprising:

a tool head having a first side, a second side, and a mid-portion between a first end and a second end, the mid-portion being shaped to fit within a slot in the end of a handle, the mid-portion further including a first cutout, a second cutout, a third cutout, and a cavity, the cavity extending through the first end and terminating before the second end of the mid-portion;

a shaft located within the cavity and defining a longitudinal axis therethrough, the shaft being rotatable about the longitudinal axis;

a first clamp located in the first cutout and threadingly engaged on the shaft, the first clamp being rotatable about the longitudinal axis from a first position to a second position, wherein the first clamp substantially nests within the first cavity in the first position, and wherein the second position is substantially perpendicular to the first position; and a second clamp located in the second cutout and slidingly engaged on the shaft, the second clamp being rotatable about the longitudinal axis from a first position to a second position, wherein the second clamp substantially nests within the second cavity in the first position, and wherein the second position is substantially perpendicular to the first position;

wherein the first clamp is urged towards the second clamp by rotating the shaft, and wherein rotating both of the first and second clamps into the second position positions the first and second clamps to compressively secure the handle end to the tool head on both the first and second sides of the tool head.

2. The tool head of claim 1, wherein the second end is a hatchet blade.

3. The tool head of claim 1, wherein a spring on the shaft urges the second clamp away from the first clamp.

4. The tool head of claim 1, further comprising a knob operatively coupled to the shaft, wherein rotating the knob causes the shaft to rotate about the longitudinal axis.

5. The tool head of claim 1, further comprising a lever operatively coupled to the shaft, wherein actuating the lever causes the shaft to rotate about the longitudinal axis.

6. The tool head of claim 1, wherein the tool head has a flat profile when the first and second claims are in the first position.

7. The tool head of claim 1, wherein the tool head is a hammer.

8. The tool head of claim 1, wherein the tool head is an axe.

9. The tool head of claim 1, wherein the tool head is a mallet.

10. The tool head of claim 1, wherein the tool head is a pick.

* * * * *